US009545790B2

(12) United States Patent
Gracia Verdugo et al.

(10) Patent No.: US 9,545,790 B2
(45) Date of Patent: Jan. 17, 2017

(54) DETERMINING A PRINT MEDIA MALFUNCTION CONDITION

(71) Applicants: Antonio Gracia Verdugo, Barcelona (ES); Valentin Gimenez Fernandez, Sant Cugat del Valles (ES); Mauricio Seras Franzoso, Sant Cugat del Valles (ES); Hewlett-Packard Development Company, L.P., Houston, TX (US)

(72) Inventors: Antonio Gracia Verdugo, Barcelona (ES); Valentin Gimenez Fernandez, Sant Cugat del Valles (ES); Mauricio Seras Franzoso, Sant Cugat del Valles (ES)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 15/029,047

(22) PCT Filed: Oct. 14, 2013

(86) PCT No.: PCT/EP2013/071449
§ 371 (c)(1),
(2) Date: Apr. 13, 2016

(87) PCT Pub. No.: WO2015/055228
PCT Pub. Date: Apr. 23, 2015

(65) Prior Publication Data
US 2016/0257150 A1 Sep. 8, 2016

(51) Int. Cl.
*B41J 29/393* (2006.01)
*B41J 2/045* (2006.01)
*B41J 11/00* (2006.01)

(52) U.S. Cl.
CPC ..... *B41J 2/04556* (2013.01); *B41J 11/0035* (2013.01); *B41J 29/393* (2013.01)

(58) Field of Classification Search
CPC ..... B41J 2/04556
See application file for complete search history.

(56) References Cited

U.S. PATENT DOCUMENTS

| | | | |
|---|---|---|---|
| 6,386,663 | B1 | 5/2002 | Olson |
| 8,419,144 | B2 | 4/2013 | Castillo et al. |
| 2004/0080553 | A1 | 4/2004 | Kim |

(Continued)

FOREIGN PATENT DOCUMENTS

| | | |
|---|---|---|
| JP | 2010173150 | 8/2010 |

OTHER PUBLICATIONS

PCT Search Report and Written Opinion, Jul. 17, 2014, PCT/EP2013/071449, Hewlett-Packard Development Company, Ltd., European Patent Office, 11 pages.

*Primary Examiner* — Julian Huffman
(74) *Attorney, Agent, or Firm* — HP Inc.—Patent Department

(57) ABSTRACT

Examples of the method may comprise providing a print media under a printhead of the printing system, obtaining an actual height profile signal, related to a height between the printhead and the print media, based on measurements taken at a plurality of positions across the width of the media during at least one pass, comparing said actual height profile signal to an earlier height profile signal, obtained based on measurements taken at said plurality of positions across the width of the media during at least one earlier pass on the same print media, and determining a media malfunction condition based on said comparison.

15 Claims, 2 Drawing Sheets

(56) References Cited

U.S. PATENT DOCUMENTS

Figure 3:
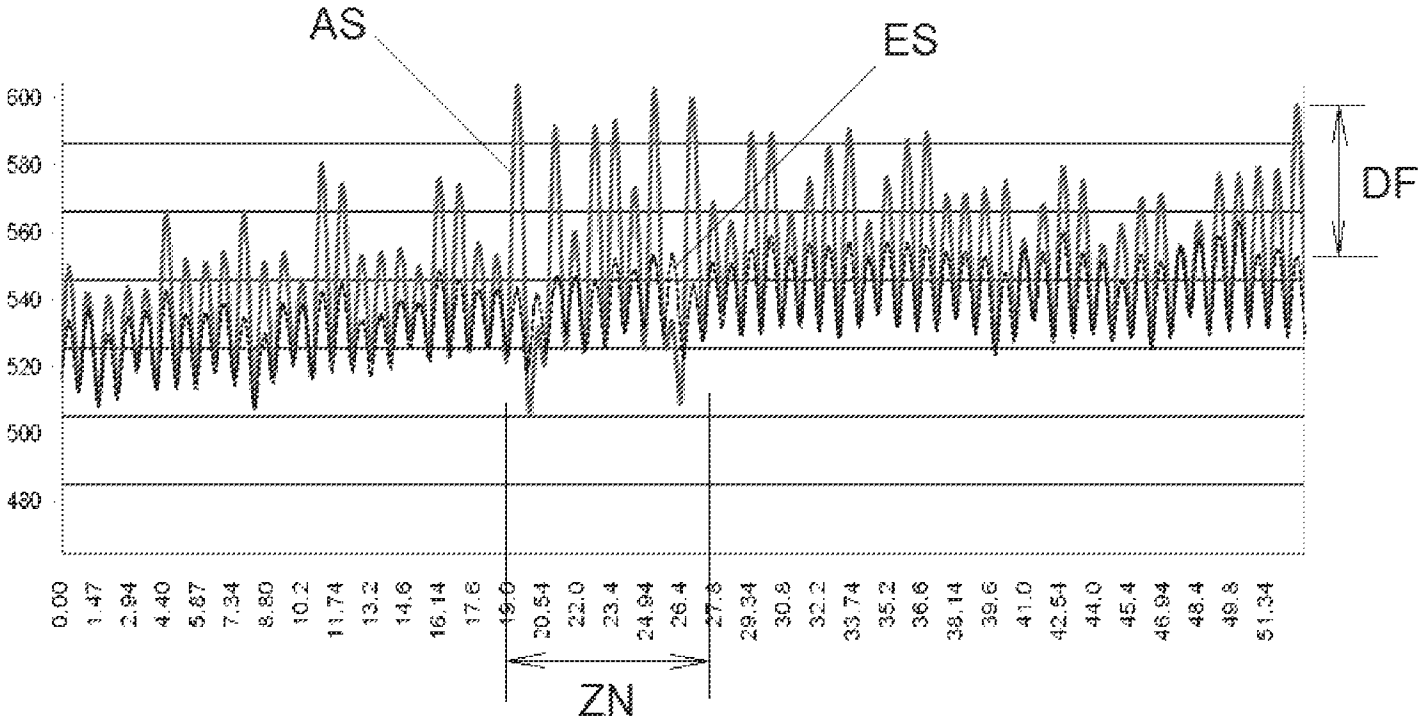

| | | | |
|---|---|---|---|
| 2005/0146548 | A1 | 7/2005 | DePena et al. |
| 2005/0195229 | A1 | 9/2005 | Barss |
| 2011/0279507 | A1 | 11/2011 | Castillo et al. |

Figure 1
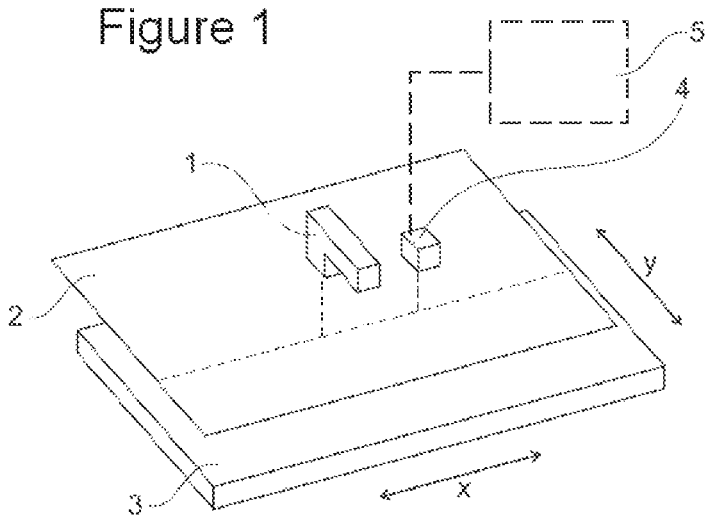
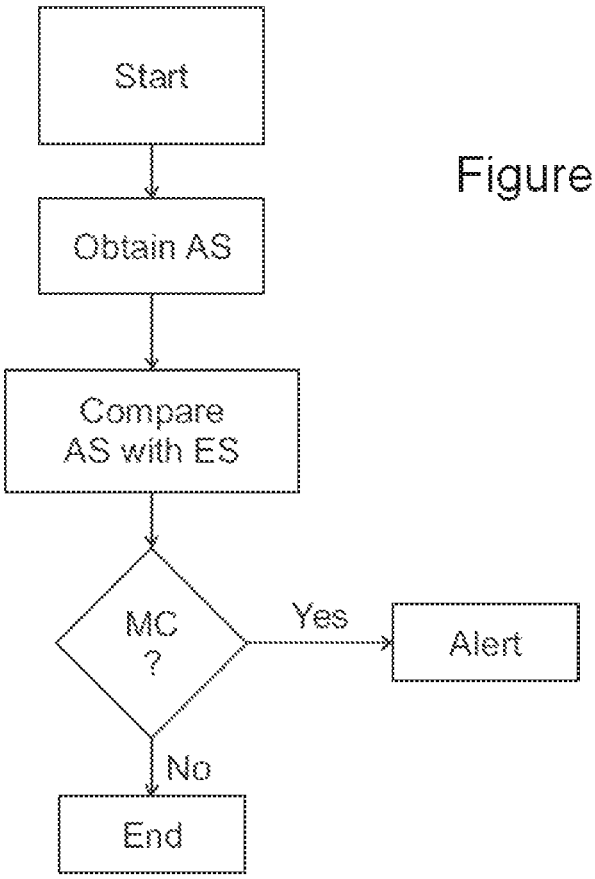
Figure 2

DETERMINING A PRINT MEDIA MALFUNCTION CONDITION

CROSS-REFERENCE TO RELATED APPLICATION

This application is a U.S. National Stage Application of and claims priority to International Patent Application No. PCT/EP2013/071449, filed on Oct. 14, 2013, and entitled "DETERMINING A PRINT MEDIA MALFUNCTION CONDITION," which is hereby incorporated by reference in its entirety.

BACKGROUND

A printing system may include a printhead to apply a printing fluid on a substrate or print media in a printing zone, in order to form a plot or image, and a platen to support the print media in the printing zone. The printhead may apply the printing fluid in successive swaths or passes over the print media along a first direction, and the print media may be advanced on the platen between swaths, in a second direction at right angles to the first direction.

The quality of the printed image depends on a number of factors, including the accuracy in the positioning on the printing fluid on the print media. This accuracy in its turn may depend inter alia on the shape of the print media under the printhead, i.e. on the height or distance between the print media and the printhead.

BRIEF DESCRIPTION

Some non-limiting examples of methods of determining a print media malfunction condition will be described in the following with reference to the appended drawings, in which:

FIG. 1 schematically shows a printing system according to an example;

FIG. 2 is a flowchart illustrating examples of methods of determining a print media malfunction condition as disclosed herein; and FIG. 3 is a graph showing examples of height profile signals related to the height between the printhead and the print media.

DETAILED DESCRIPTION

Examples of a printing system may comprise, such as shown in FIG. 1, a printhead 1 to apply a printing fluid on a print media 2 to form a plot or image, and a platen 3 to support the print media 2 under the printhead 1.

The printhead 1 may apply the printing fluid in successive swaths or passes over the print media 2 along the media width direction or scan direction X, and the print media may be advanced between swaths along an advance direction Y at right angles to direction X.

The printing system may be a scanning printing system, wherein the printhead 1 may be mounted on a carriage that reciprocates along the X direction, or may be a page wide array (PWA) system, wherein the printhead 1 is stationary and spans across the print media width in the X direction.

The height or distance between the print media 2 and the printhead 1 may affect print quality, e.g. because it may affect the positioning of printing fluid on the media 2. In order to maintain the print media 2 relatively flat, in some printing systems the platen 3 may be provided for example with an upper surface with a suitable shape, and may be provided with a hold-down device, such as a vacuum hold-down device.

Furthermore, the height between the print media 2 and the printhead 1 may be monitored to detect malfunctioning conditions of the print media 2 such as creases, wrinkles, bubbles and the like, which may cause defects in the printed image, for example errors in the positioning of the printing fluid.

Examples of methods and printing systems as disclosed herein allow controlling the shape of the media, and determining a media malfunction condition.

In examples, and as shown in FIG. 1, a printing system may comprise a sensor 4, in order to take measurements related to the height between the printhead 1 and the print media 2, and a controller 5.

The sensor 4 may be a line sensor. In some examples, a line sensor may comprise an LED emitter to emit an optical beam towards the media, and a photo transistor detector to detect the reflection of the optical beam.

In some examples, the controller 5 may control the sensor 4 to take measurements related to the height between the printhead 1 and the print media 2 at a plurality of positions across the width of the media, i.e. in direction X, during at least one pass. The measurements may be taken during a printing pass; or during a pass in which no printing fluid is deposited on the print media.

Based on such measurements, a height profile signal may be obtained: a height profile signal is herein a signal that represents the height between the media and the printhead across the media width.

Once a print media is provided under a printhead of a printing system, examples of a method of determining a print media malfunction condition may comprise, as illustrated by the flowchart in FIG. 2:

- taking measurements at a plurality of positions across the width dimension of the media, in at least one pass over the media, and based on such measurements obtaining an actual height profile signal AS, which is representative of the height existing between the printhead and the print media at said positions;
- comparing said actual height profile signal AS to an earlier height profile signal ES, that is, to a signal which has been obtained in at least one earlier pass on the same print media, based on measurements taken at said plurality of positions; and
- determining a media malfunction condition MC based on said comparison, Examples of methods as disclosed herein therefore allow controlling the shape of the media and detecting defects such as an excessive deformation, wrinkles or the like, by comparing the shape of the print media at a given time with the shape of the same print media in an earlier pass.

The determination of the print media malfunctioning condition may thus be made without the need of a predetermined or fixed reference, for example a shape that is expected for the media based on the shape of the platen. Such a predetermined reference may be suitable for some print media such as thin paper; but other media, such as for example thick textiles or banners, wallpaper substrates and others, may not follow the platen shape or may give misleading results in a comparison with a fixed reference.

Examples of the method may thus allow monitoring at least some kinds of print media more reliably than by comparing a height profile signal with a fixed reference.

Examples of the method as disclosed herein may be performed ed to continuously monitor the height or distance between the print media and the printhead during a printing operation. Detecting a malfunction condition of the print media allows stopping the printing operation, or adjusting or rectifying the printing conditions, such that waste of media and printing fluid may be avoided or reduced.

Examples of the method may be carried out in a printing system such as disclosed above with reference to FIG. 1, wherein the controller 5, by using measurements taken by the sensor 4, obtains the actual height profile signal AS, compares it with an earlier height profile signal ES, and determines a media malfunction condition MC based on said comparison.

In examples, the sensor 4 may be arranged to travel along the X direction on a carriage, such as the printhead carriage in a scanning printer. In a PWA printer, it is also possible to arrange a plurality of sensors 4 at discrete positions along the X direction.

FIG. 3 shows a graph of height profile signals obtained in application of an example of a method as disclosed herein.

The horizontal axis of the graph represents the width of the media (X direction in FIG. 1), in this case in inches. As shown, an example of the method is applied herein to a print media over a width of about 53 inches (about 134.62 cm).

The vertical axis represents the output values of the line sensor 4 arranged to take measurements related to the height or distance between the printhead 1 and the print media 2. The units of the vertical axis are not the height between printhead and print media, but other units (e.g., sensor output) related to this height; however, the actual height units are not necessary, because in examples of the method, the determination of a malfunction condition relies on comparisons between signals and not on the absolute values thereof.

The graph shows that measurements are taken at a plurality of positions across the media width, during a pass of the sensor; in this example measurements are taken approximately each 10.55 mm. Based on these measurements, a height profile signal may be obtained, i.e., a signal that represents the height between the media and the printhead across the media width.

In FIG. 3, the continuous line may represent the actual height profile signal AS, while the dotted line may represent an earlier height profile signal ES, that is, a signal based on measurements that were taken in a pass performed earlier than the pass based on which the actual height profile signal is obtained. Each signal represents the shape of the print media across its width, which is approximately sinusoidal. This may correspond to a platen having a plurality of parallel channels on its upper surface, and a media hold-down device.

There may be a difference DF between the actual height profile signal AS and the earlier height profile signal ES at each position, and the difference DF may be larger or smaller depending on how much the shape of the media (i.e., the height between the media and the printhead) has changed at each position. One of the differences DF has been indicated by way of example at the right end of the graph.

By comparing the actual height profile signal AS to the earlier height profile signal ES, a media malfunction condition may be determined. As illustrated n FIG. 3, in one implementation, a malfunction condition may be determined, for example, if at least one difference DF between AS and ES exceeds a certain threshold. In another implementation, the malfunction condition may be determined if there is a certain number of positions for which the difference DF exceeds a threshold. In a further implementation, the malfunction condition may be determined if there is a certain number of positions within a certain interval, for example a zone ZN as shown in FIG. 3, for which the difference DF exceeds a threshold. Such a zone ZN may be defined herein as a portion of the media in the width direction. Other determinations or combinations thereof may also be performed.

In some examples, the actual height profile signal AS and/or the earlier height profile signal ES may be obtained during one pass across the width of the media. In alternative examples, the actual height profile signal AS and/or the earlier height profile signal ES may be an average of height profile signals obtained during a predetermined number of passes across the width of the print media.

In particular, the comparison may be made between height profile signals, each of which corresponds to a single pass across the media, or between height profile signals, each of which is an average of the signals corresponding to a number of passes. In some other examples, an actual height profile signal AS corresponding to a single pass may be compared with an earlier height profile signal ES that is an average between several earlier passes. The contrary is also a possibility, i.e., an actual height profile signal AS that is an average between several passes may be compared with an earlier height profile signal ES corresponding to a single earlier pass.

In some examples, the earlier height profile signal ES with which an actual height profile signal AS is compared may be the immediate earlier signal obtained. In other examples, the method may foresee to compare the actual height profile signal AS with an earlier height profile signal ES that is not the signal obtained immediately before the actual signal, but an even earlier or "older" signal, corresponding to swaths that are not adjacent to the actual swath. The earlier height profile signal ES may be for example one that is obtained at the beginning of a print job on a print media and is then employed to compare with the successive height profile signals obtained in later passes on the rest of the print job.

According to some examples, a media malfunction condition may be determined when the difference between the actual height profile signal AS and the earlier height profile signal ES exceeds a predetermined threshold in at least one position across the width of the print media. If the difference exists in one position or in a few positions across the media, this may indicate the presence of small wrinkles, affecting only reduced areas of the print media.

According to other examples, a media malfunction condition may be determined if the difference between the actual height profile signal AS and the earlier height profile signal ES exceeds a predetermined threshold in a predetermined number of positions across the media. In this case, positive determination of a malfunction condition is limited to the case where defects in the media are affecting a certain proportion of the print media width.

In some examples it may be foreseen to determine a media malfunction condition when there are a sufficient number of defects concentrated in a certain zone of the print media width. In such cases a media malfunction condition is determined if the difference between the actual height profile signal and the earlier height profile signal exceeds a predetermined threshold in a predetermined number of positions across the width of the print media and said positions are within a predetermined media width dimension, i.e., said positions are in a limited width zone.

In other examples, a media malfunction condition may be determined if the average difference between the actual height profile signal and the earlier height profile signal across all the media exceeds a predetermined threshold. In such examples where determination is based on an average, a malfunction is determined both with large differences between the two signals in a few points and with smaller differences in a larger number of points, and regardless of the location of the points across the media width.

In examples of the method, it is possible to combine more than one situation for determining print media malfunction. More specifically, two or more of the above or of other determinations may be applied at the same time.

In such cases, in examples of the method different predetermined thresholds may be applied to the different determinations. For example, a higher threshold may be applied to an average difference across all the width of the media, and a lower threshold may be applied to a difference in a specific zone of the width.

It is also possible, in examples of the method, to apply predetermined thresholds that are different between one interval of positions across the media width and another, i.e., between one zone of the media width and another. Such a method may be employed for example for monitoring more strictly zones or areas of the media width on which more printing fluid is deposited. Moreover, such method may be employed also for excluding from the determination some areas where no printing fluid is deposited, since defects in such areas are not critical.

In some examples of the method, such as methods performed in a scanning printing system, the measurements for obtaining the height profile signals may be taken by a sensor, for example a line sensor, arranged on a printhead carriage. Since the carriage carries the printhead and performs passes across the width of the media, a sensor arranged on this carriage may provide accurate and reliable measurements related to the distance between the media and the printhead.

In examples of the method, the measurements may be taken in each printing pass.

The media may be advanced predetermined lengths in the media advance direction Y between one pass wherein measurements are taken and another pass wherein measurements are taken.

According to some examples, the method may further comprise issuing an alert for a user, stopping a current print job, or both, in case a media malfunction condition is determined, such that action may be taken to solve the problem, and/or further waste of media and printing fluid may be avoided.

In some examples, a method of determining a print media malfunction condition in a printing system such as that shown in FIG. 1 may comprise, after providing a print media 2 under a printhead 1 of the printing system:

taking measurements, for example by means of the sensor 4, each representing the height between the media 2 and the printhead 1, at a plurality of positions in the width direction X of the media 2, and obtaining based on such measurements a first height profile signal, wherein this signal represents the height between the media 2 and the printhead 1 across the media width;

advancing the media a predetermined length, such as at least one printing swath length, in the media advance direction Y of the printing system, at right angles to the width direction X of the media 2;

taking another set of measurements, each representing the height between the media 2 and the printhead 1, at the same positions in the width direction X of the media, and obtaining based on such measurements a second height profile signal, which represents the height between the media 2 and the printhead 1 across the media width, after the media advance;

comparing the first and second height profile signals; and determining a media malfunction condition based on said comparison, In some examples, the second height profile signal may correspond to the actual height profile system AS described above, and the first height profile system may correspond to the earlier height profile signal ES.

In some implementations of the method, a malfunction may be determined if the differences between the first and second height profile signals exceed predetermined thresholds, as explained above.

Although only a number of particular implementations and examples have been disclosed herein, further variants and modifications of the disclosed apparatus and methods are possible; other combinations of the features of implementations or examples described are also possible.

The invention claimed is:

1. A method of determining a print media malfunction condition in a printing system, comprising:

providing a print media under a printhead of the printing system;

obtaining an actual height profile signal, related to a height between the printhead and the print media, based on measurements taken at a plurality of positions across the width of the media during at least one pass;

comparing said actual height profile signal to an earlier height profile signal, obtained based on measurements taken at said plurality of positions across the width of the media during at least one earlier pass on the same print media; and determining a media malfunction condition based on said comparison.

2. The method of claim 1, wherein the actual height profile signal is obtained during one pass across the width of the media.

3. The method of claim 1, wherein the earlier height profile signal is obtained during one earlier pass across the width of the media.

4. The method of claim 1, wherein the actual height profile signal is an average of height profile signals obtained during a predetermined number of passes across the width of the media.

5. The method of claim 1, wherein the earlier height profile signal is an average of height profile signals obtained during a predetermined number of passes across the width of the media.

6. The method of claim 1, wherein a media malfunction condition is determined if the difference between the actual height profile signal and the earlier height profile signal exceeds a predetermined threshold in at least one position across the width of the print media.

7. The method of claim 1, wherein a media malfunction condition is determined if the difference between the actual height profile signal and the earlier height profile signal exceeds a predetermined threshold in a predetermined number of positions across the width of the print media.

8. The method of claim 7, wherein a media malfunction condition is determined if the difference between the actual height profile signal and the earlier height profile signal exceeds a predetermined threshold in a predetermined number of positions across the width of the print media and said positions are within a predetermined media width dimension.

9. The method of claim 1, wherein a media malfunction condition is determined if the average difference between the actual height profile signal and the earlier height profile signal across the width of the media exceeds a predetermined threshold.

10. The method of claim 1, wherein the determination of a media malfunction condition based on the comparison between the actual height profile signal and the earlier height profile signal is performed by applying predetermined thresholds that are different between one interval of positions across the media width and another interval of positions across the media width.

11. The method of claim 1, wherein said measurements are taken by a sensor arranged on a printhead carriage.

12. The method of claim 1, further comprising at least one of issuing an alert for a user or stopping a current print job in case a media malfunction condition is determined.

13. A method of determining a print media malfunction condition in a printing system, comprising:

providing a print media under a printhead of the printing system;

obtaining a first height profile signal, representing the height between the media and the printhead across the media width, based on measurements taken at a plurality of positions in the width direction of the media;

advancing the media a predetermined length in an advance direction at right angles to the width direction of the media;

obtaining a second height profile signal, based on measurements at the plurality of positions in the width direction of the media, said second height profile signal representing the height between the media and the printhead across the media width, after the media advance;

comparing the first and second height profile signals; and determining a media malfunction condition based on said comparison.

14. A printing system, comprising:

a printhead;

a platen for supporting print media under the printhead;

a sensor to take measurements related to the height between the printhead and the print media; and a controller to control said sensor and to obtain an actual height profile signal, based on measurements taken by the sensor at a plurality of positions across the width of the media during at least one pass, to compare said actual height profile signal to an earlier height profile signal, obtained based on measurements taken by the sensor at said plurality of positions across the width of the media during at least one earlier pass on the same print media, and to determine a media malfunction condition based on said comparison.

15. The printing system of claim 14, wherein the sensor is a line sensor.

* * * * *